United States Patent [19]

Stromire

[11] Patent Number: 5,003,862

[45] Date of Patent: Apr. 2, 1991

[54] METHOD AND APPARATUS FOR ARMAMENT CONTROL

[76] Inventor: Mark L. Stromire, 12532 Woodstock Dr., E., Upper Marlboro, Md. 20772

[21] Appl. No.: 344,958

[22] Filed: Apr. 28, 1989

[51] Int. Cl.[5] ..... F41A 19/05

[52] U.S. Cl. ..... 89/133

[58] Field of Search ..... 89/41.18, 133, 134

[56] References Cited

U.S. PATENT DOCUMENTS

| | | | |
|---|---|---|---|
| 1,466,951 | 9/1923 | Edwards | 89/133 |
| 3,618,456 | 11/1971 | Mindel | 89/134 |
| 4,237,462 | 12/1980 | Lemke et al. | 89/133 |

*Primary Examiner*—Stephen C. Bentley
*Attorney, Agent, or Firm*—Richard C. Litman

[57] ABSTRACT

An armament control system for helicopter mounted weapons is disclosed in which the area of fire could penetrate the arc created by the rotating blades. The system consists of subsystems which provide data for the rotor blade position and the armament aim and a control circuit to discriminate the firing of the armament when conditions meet the set criteria. The rotor blade position data subsystem may be used to provide information for a plurality of control circuits and weapons.

7 Claims, 3 Drawing Sheets

METHOD AND APPARATUS FOR ARMAMENT CONTROL

FIELD OF THE INVENTION

The present invention relates to an armament control system and in particular to a control system for the synchronization of a weapon or weapons firing between the rotating blades of a helicopter.

BACKGROUND OF THE INVENTION

Methods for synchronizing the rotating blades of aircraft with the aircraft armament have previously been disclosed in patents which date prior to 1920.

The prior art shows many examples of timing a fixed weapon with the propeller of an aircraft by mechanical means. These means usually included a timing chain or cam which was driven by the drive shaft of the engine. The early methods of synchronization were relatively unsophisticated due to fixed weapons. However, ever changing air warfare of the first world war and the years after dictated that technological improvements be made. These included electrical control systems, multiple weapons and control systems in which the weapons are movable. The first two mentioned improvements were relatively simple in that the systems were merely converted from mechanical to electrical operation or additional timing gears or cams were added for additional weapons. The movable or traversable weapon, however, provided a sophistication hitherto unseen in the art.

As an example, U.S. Pat. No. 1,349,140 issued to Martel et al. discloses a control system for a machine gun. The patent teaches the use of a control member that allows for traversing of the weapon while providing synchronization between weapon, propeller and fixed parts of the aircraft. This provides for aiming of the weapon without changing the course of the aircraft. While the invention has its merits, it is unsuited for adaptation to a helicopter because of the mechanical cooperation between the weapon and the drive shaft of the engine.

SUMMARY OF THE INVENTION

By the present invention, an improved method of timing the rotating elements of an aircraft with a pivotally mounted armament is disclosed. The invention provides the integration of a blade position determining means, armament aim determining means and a logic system for control.

Accordingly, one of the objects of the present invention is to accommodate the simultaneous firing and movement of the weapon while the rotor blades rotate. This will provide for the everchanging needs and demands of a helicopter weapon system.

Additionally, an object of the invention is to provide an improved synchronizing system comprising electronic circuitry. This provides for increased sophistication and accuracy which is necessary to meet the demands of the constantly changing conditions of blade position and weapon aim.

A further object of the invention is to provide for the firing of the armament through any location of the arc created by the rotation of the rotor blades. This will provide for firing at a plurality of angles in order to effectively counter any threat.

Another object of the invention is to provide a maximum rate of fire. By discharging the weapon at the point of optimum blade position, the rate of fire will be consistent and at a maximum.

Further, an object of the invention is to provide a control system in which no mechanical cooperation between the armament and rotating blades exists. This provides for a simplified system with discrete subsystems.

Still another object of the invention is to provide a system capable of controlling a plurality of weapons which may be installed on a single aircraft.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
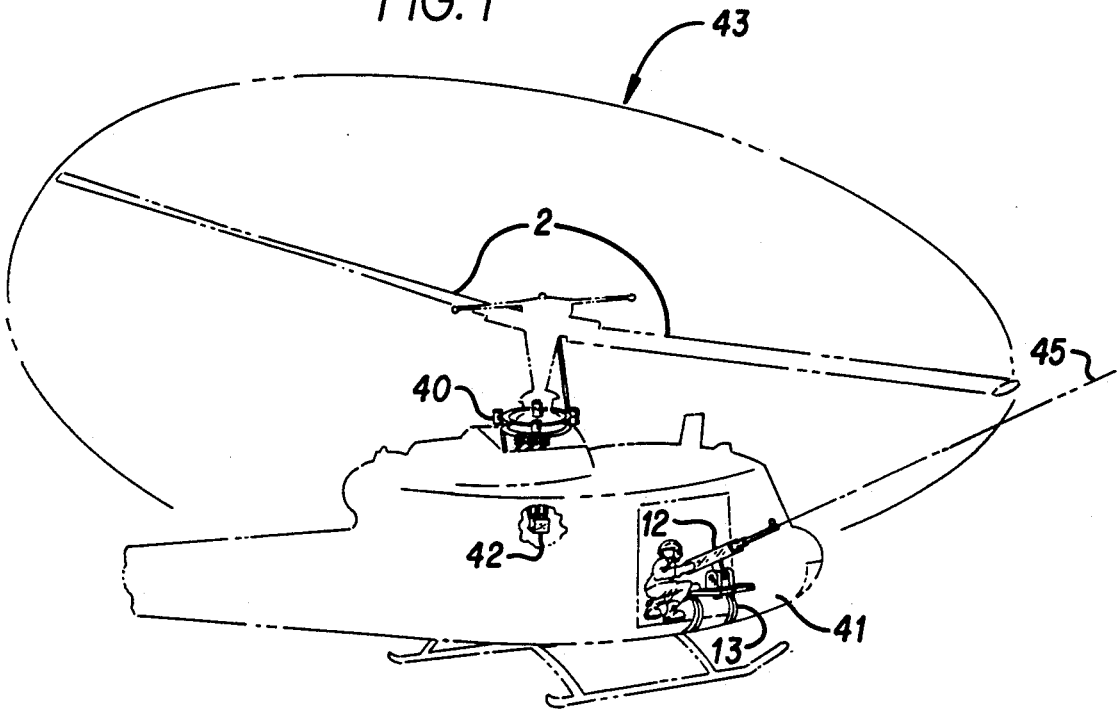
FIG. 1 is a perspective view of the components of the system, including the device to determine rotor position and the armament mount along with the device for determining the position of the armament.
Figure 2:
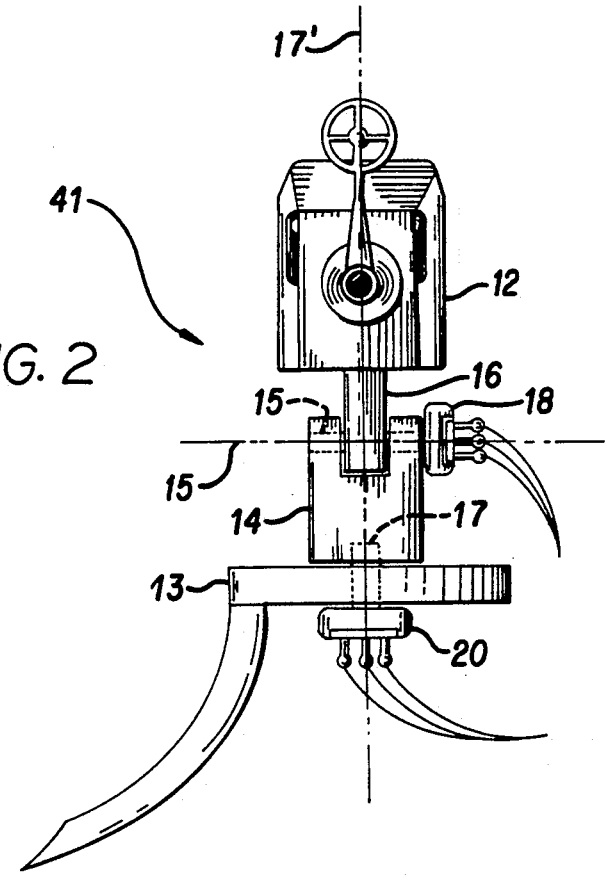
FIG. 2 is a side view of the weapon and mount showing the location of the potentiometers.

Referring now to the drawings, particularly to FIG. 1, the present invention contemplates the method and apparatus for firing a projectile 45 through the plane 43 created by the rotating blades 2 of a helicopter. The weapon system, best shown in FIG. 2, is seen to include the armament 12, mount 13, and weapon position sensing potentiometers 18 and 20, generally comprising armament or weapon system 41. The rotor blade position subsystem 40 provides blade position information, and the electronic subsystem 42 controls the system.

The armament or weapon system 41 includes the means by which the weapon 12 is secured to mount 13 and the disposition of horizontal potentiometer 18 and vertical potentiometer 20. The mount 13 provides for movement of the armament 12 about both the horizontal axis 15' and the vertical axis 17'. The mount body 14 is provided with horizontal bores to receive the horizontal pin 15. The weapon mount 16 which is integral to the weapon 12 is also provided with a bore to accommodate the pin 15. The pin 15 in conjunction with the weapon mount 16 provides for movement about the axis 15'. The mount is also provided with a vertical bore whose center lies on axis 17'. The bore will accommodate the vertical pin 17 which allows for the transverse movement of the mount body 14.

The potentiometers 18 and 20 which determine the relative angular rotation about both axis 15' and axis 17' are mounted on pins 15 and 17, respectively. The potentiometer 18 which determines the elevation of the weapon 12 is connected to the pin 15. The potentiometer 20 connected to pin 17 provides for the determination of the transverse movement. The signals produced by the potentiometers 18 and 20 are used to determine the zone of intersection between the rotor plane 43 and the pathe of the projectile 45. The potentiometers 18 and 20 provide a voltage reading which is proportional to the angular displacement about a given axis.

Figure 4:
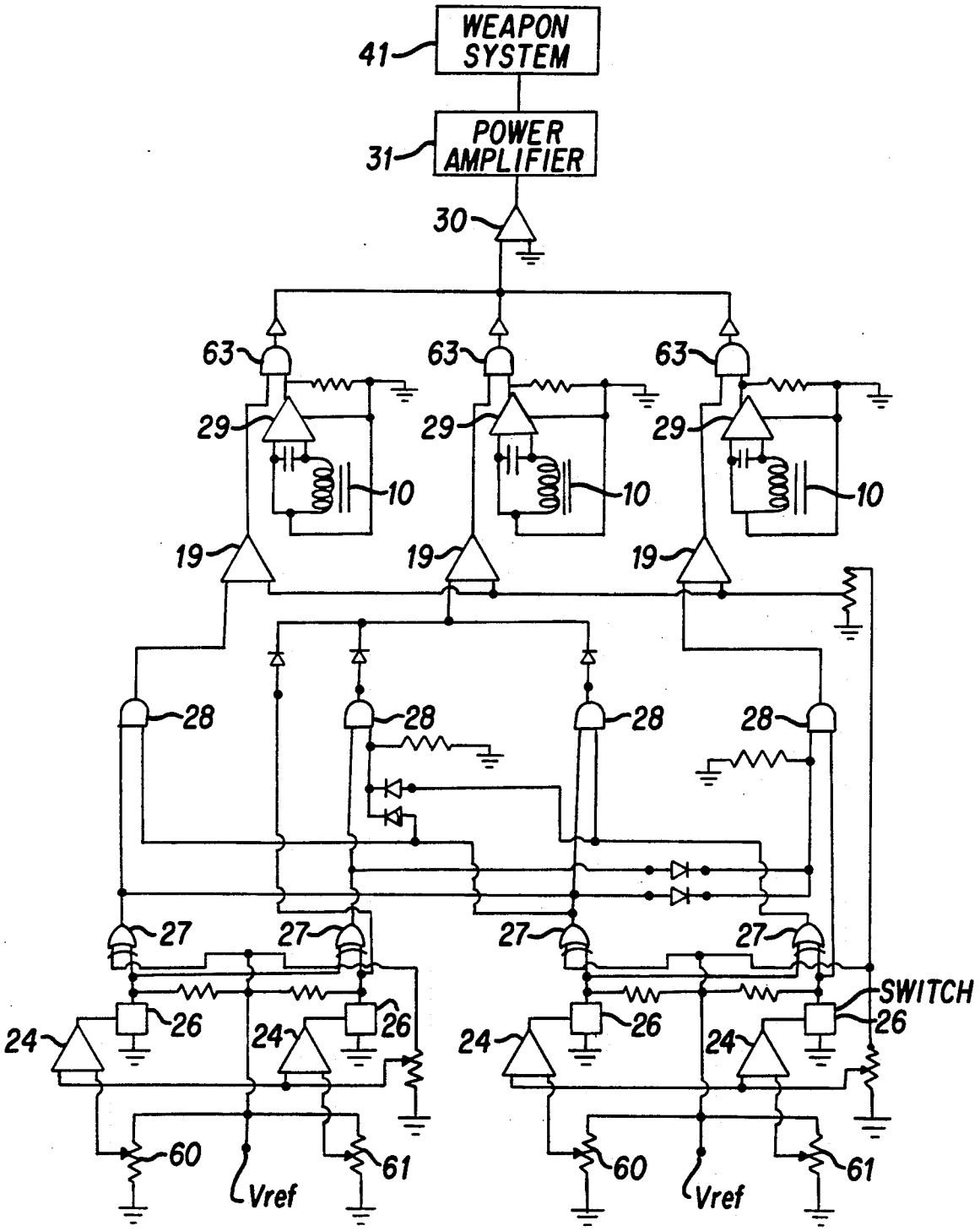
FIG. 4 is an electrical schematic of the operation and interaction of the system.

The logic system 42 is shown in FIG. 4. The potentiometers 18 and 20 of weapon system 41 supply a voltage to comparators 24 when weapon 12 is elevated or traversed. The supplied voltage is compared to the voltage from the calibration pots 60 and 61. The calibration pots 60 and 61 are set with respect to such variables as the number of rotor blades 2 and the location of the weapon system 41 with the rotor shaft axis 9 as the reference. A voltage reference, Vref, is supplied to system 42 for calibration and operation. The comparators 24 determine which signal has the greater voltage. If the signal from potentiometer 18 or 20 is greater than the signal of the reference, the switch 26 opens and sends the signal to the EXCLUSIVE-OR gate 27. The analog signals produced by the potentiometers 18 and 20 are then converted into digital signals by the EXCLUSIVE-OR gates 27 for processing by the control subsystem of FIG. 4. The EXCLUSIVE-OR gate 27 will distinguish the signals it receives as similar or different. If the signals are alike, no output is produced. If the signals are different, output is produced and the output is sent to the AND gate 28. The AND gate 28 will, upon receipt of similar signals to all of its inputs, produce an output which it sends to comparator 19. The comparator 19 serves as a filter to eliminate noise in the system and determine if the signal received from the AND gates 28 is indeed genuine. When the output is determined to be genuine, it is sent to the AND gate 63 which controls the synchronization with the rotor position system 40. Amplifiers 29 provide a second input signal to the AND gates 63, and amplifier 30 provides the processed signal output to the power amplifier 31 and thence to weapon system 41.

Figure 3:
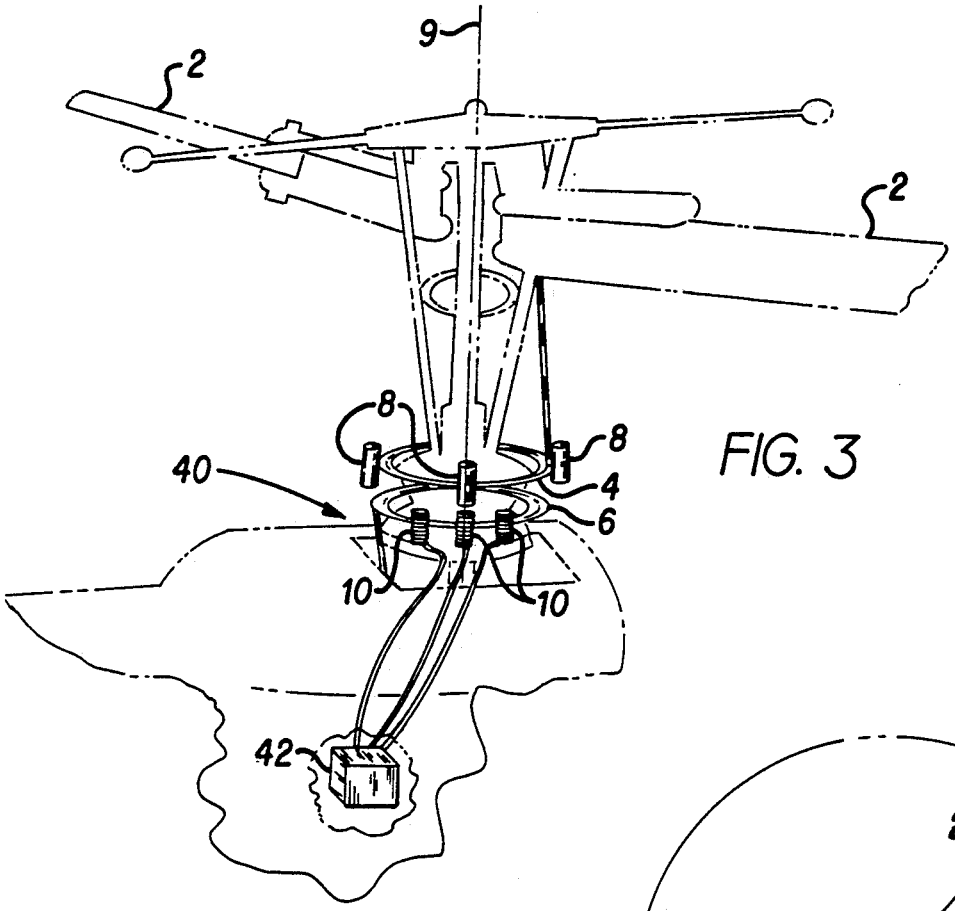
FIG. 3 is a perspective view showing the rotor shaft and swashplates attached thereto.

The rotor position system generally designated 40 provides the logic system 42 with the location at any given time of the rotor blade 2. The system is comprised of a plurality of magnets 8 mounted on the rotating swashplate 4, best shown in FIG. 3. The rotating swashplate 4 and stationary swashplate 6 along with the rotor shaft are concentric about axis 9. The magnets 8 are located on the perimeter of the rotating swashplate 4 which is in turn directly beneath the rotor blades 2. These magnets 8 are aligned in an arc shared with the plurality of coils 10 which are fixedly attached to the stationary swashplate 6. The rotation of the magnets 8 generates an AC signal in the coils 10 when the magnets pass overhead. At the instant the voltage is generated in the coils the position of the blade is seen to be directly above the coil which generated the voltage.

Figure 5A:
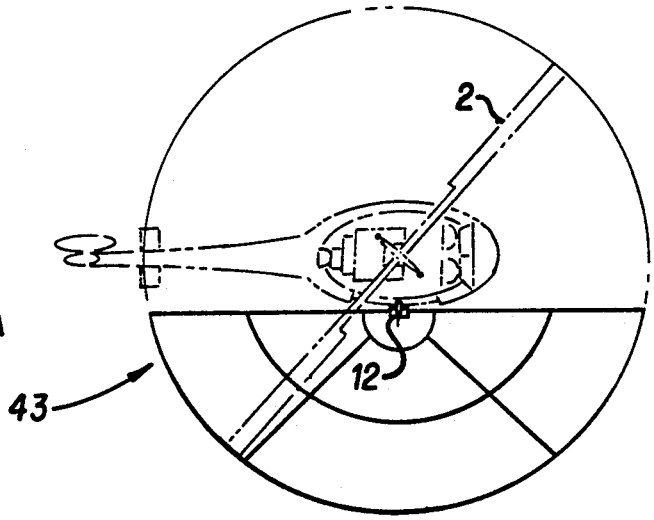
FIG. 5A is an overhead view of the geometric relationships between horizontal and vertical areas formed by the adjustment of the calibration pots and the aim of the weapon.
Figure 5B:
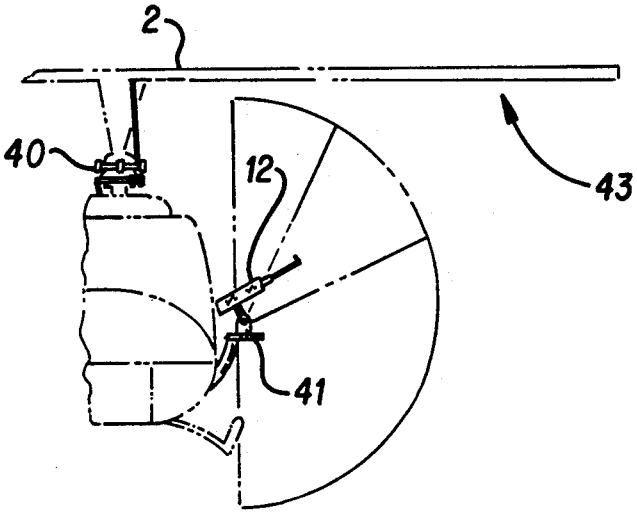
FIG. 5B is a side view of the geometric relationship showing the angular periphery of the vertical areas formed by the calibration pots.

With the position of the rotor blades 2 determined by the rotor position system 40 and the zone of aim of the weapon 12 found by the logic subsystem 42, the weapon 12 can be safely fired and the projectile 45 will pass through plane 43 without encountering obstructions. Overhead and side views of these zones may best be seen in FIGS. 5A and 5B. When an AC signal is produced in a coil 10 in conjunction with the positive signal from the logic subsystem 42, a further signal will be sent to the power amplifier 31 and subsequently to the weapon 41. The weapon 12 will be provided with an electrical firing mechanism, not shown, which would either be integral to its design or adapted to the mechanical firing mechanism. The signal, upon reaching weapon 12, will cause weapon 12 to fire one round 45. Thus, the entire system will control the firing of weapon 12 when the inputs meet the specifications for operation as disclosed above, as opposed to the previous systems which provide for the cessation of firing when an obstruction moved into the path of fire.

It will be seen that the signals produced by rotor position system 40 may be transmitted to a plurality of logic subsystem units 42, one such logic subsystem 42 for each weapon 12 installed on board a given helicopter. Thus, synchronization and control may be provided for a plurality of weapons 12 from a single rotor position system 40.

It is to be understood that the present invention is not limited to the sole embodiment described above, but encompasses any and all embodiments within the scope of the following claims.

What is claimed is:

1. A control apparatus for synchronous operation of an armament and a plurality of blades rotating in an arcuate path comprising;

a drive shaft to which said blades are fixedly attached providing for the rotation of said blades in a substantially horizontal plane vertically disposed above said armament;

stationary means adjacent to said shaft;

rotating means fixedly attached to said shaft and cooperating with said stationary means;

a mount providing for secure retention of said armament;

said mount having elevational means and also traversal means;

rotor blade position means for providing a determination of position of said blades, said rotor blade position means includes a plurality of coils on said stationary means and plurality of magnets on said rotating means, said rotor blade position means receives a signal generated in said coils by said magnets and said generated signal indicates position of said blades in said arcuate path;

armament aim means providing for an indication of aim of said armament, said indication of aim including both vertical elevation and horizontal traversal; and control means receiving said determination of position and said indication of aim to provide synchronous operation of said armament and said rotating blades.

2. A control apparatus according to claim 1 wherein, said armament aim means includes a plurality of potentiometers having a reference voltage applied located on said traversal means and said elevational means; and said armament aim means determines a variance of said reference voltage in said potentiometers.

3. A control apparatus according to claim 1 wherein, said control means includes a logic circuit and a power amplifier;

said control means provides for interpretation and analysis of said signal received from said rotor blade position means and said variance of reference voltage from said armament aim means; and said control means providing for determination of an optimum blade rotational position, based on processing by said logic circuit, and relays a command to discharge said armament to said power amplifier.

4. A control apparatus according to claim 1 wherein, said rotor blade position means provide such determination of said blade position to a plurality of said control means, and said plurality of control means control a plurality of said armaments.

5. The method of synchronous control for an aircraft operable between an armament and a plurality of blades whose rotation forms an arcuate path disposed vertically above said armament, comprising the following steps:

continuously determining position of said blades in said path of arcuation;

continuously calculating penetration through said path of arcuation of a projectile discharge by said armament including vertical elevation and horizontal traversal of said penetration; and synchronizing activation of said armament and said rotor blades to provide for a maximum rate of discharge of said armament between said blades, activating said armament when said penetration through said path of arcuation does not coincide with one of said blades.

6. The method of synchronous control according to claim 5 further comprising, calculating of a plurality of said projectile discharges by a plurality of said armaments; and synchronizing activation of a plurality of said armaments and said rotor blades.

7. A control apparatus for synchronous operation of an armament and a plurality of blades rotating in an arcuate path comprising:

a drive shaft to which said blades are fixedly attached providing for the rotation of said blades in a substantially horizontal plane vertically disposed above said armament;

stationary means adjacent to said shaft;

rotating means fixedly attached to said shaft and cooperating with said stationary means;

a mount providing for secure retention of said armament beneath said horizontal plane means;

said mount having elevational means and also traversal means;

rotor blade position means for providing a continuous determination of position of said blades;

armament aim means providing for a continuous indication of aim of said armament, said indication of aim including vertical elevation and horizontal traversal; and control means receiving said continuous determination of rotor blade position and said indication of aim to provide synchronous operation of said armament and said rotating blades, said control means activating said armament when said indication of aim and said determination of position do not coincide.

* * * * *